US007686269B1

(12) United States Patent
Beal

(10) Patent No.: US 7,686,269 B1
(45) Date of Patent: Mar. 30, 2010

(54) HANDS AWAY PHARMACEUTICAL HOLDER

(76) Inventor: Terry J. Beal, 2117 S. Clear Creek Rd., Killeen, TX (US) 76549-4110

( * ) Notice: Subject to any disclaimer, the term of this patent is extended or adjusted under 35 U.S.C. 154(b) by 619 days.

(21) Appl. No.: 11/424,931

(22) Filed: Jun. 19, 2006

Related U.S. Application Data

(63) Continuation-in-part of application No. 10/187,946, filed on Jul. 3, 2002, now abandoned.

(51) Int. Cl.
*A47K 1/08* (2006.01)

(52) U.S. Cl. ..... 248/313; 248/104; 248/309.1; 294/33

(58) Field of Classification Search ..... 248/313, 248/311.2, 309.1, 200, 103, 104; 81/64, 81/3.4, 3.44; 294/33; D24/128
See application file for complete search history.

(56) References Cited

U.S. PATENT DOCUMENTS 1,782,886 A * 11/1930 Axell ..... 294/33
2,864,575 A * 12/1958 Stewart ..... 248/103
3,342,443 A * 9/1967 Bennyhoff ..... 248/104
3,521,846 A * 7/1970 Copony ..... 248/139
3,773,287 A * 11/1973 Hechinger ..... 248/102
6,581,886 B1 * 6/2003 Suh ..... 248/104
7,216,837 B2 * 5/2007 Pineda ..... 248/104
2008/0066328 A1 * 3/2008 Bohn ..... 33/265

* cited by examiner

*Primary Examiner*—Anita M King
(74) *Attorney, Agent, or Firm*—Michael Diaz

(57) ABSTRACT

The present invention provides a medical safety device for holding a container. The medical safety device is used to hold the container while extracting liquid by a syringe from the container. The medical safety device is a unitary flexible main body having two opposing ends. On each end is a hand hold for grasping by the user's hands. A longitudinal slit is positioned within a center portion of the main body. When opposing force is applied to both ends toward the center of the main body, the slit widens, allowing positioning of the container within the slit. Release of the force upon the ends narrows the slit and the container is retained within the slit of the medical safety device. The user may then extract the liquid from the container without holding the container.

15 Claims, 6 Drawing Sheets

HANDS AWAY PHARMACEUTICAL HOLDER

RELATED APPLICATIONS

This application is a continuation-in-part of a U.S. patent application Ser. No. 10/187,946 by Dr. Terry Beal entitled "SAFETY DEVICE FOR HOLDING A VIAL OR AMPULE," filed Jul. 3, 2002 now abandoned and is hereby incorporated in its entirety by reference herein.

BACKGROUND OF THE INVENTION

1. Field of the Invention

This invention relates to medical safety equipment. Specifically, and not by way of limitation, the present invention relates to a device for holding a container of medicinal or diagnostic agent.

2. Description of the Related Art

As discussed in U.S. patent application Ser. No. 10/187,946 to Beal (Beal), healthcare workers are often required to dispense medication via a syringe from a via or ampule. Normally, the healthcare worker is required to insert a needle of the syringe though a seal on the top portion of a vial, load the syringe with medication, and then inject the medication into the patient. However, there are two well-know safety hazards which are present during this procedure.

One problem involves the risk of accidental needle sticking while loading a syringe, such as where a healthcare worker accidently sticks himself or sticks another individual who is assisting in loading the syringe. This risk is particularly acute when one person holds the vial while the other person inserts the needle into the vial or when the syringe is loaded in a dimly lit room. Each year, hundreds of thousands of health care workers suffer from needle stick accidents. Obviously this is a dangerous situation where the healthcare worker is at risk for contracting many types of blood borne illnesses, such as hepatitis C virus (HCV), hepatitis B virus (HBV), human immunodeficiency virus (HIV) and other viral and bacterial diseases.

Another problem occurs when a healthcare worker must load a syringe while working in a sterile environment. In such a situation, loading a syringe presents the risk of contaminating either the healthcare profession or the environment. For example, when a doctor is performing surgery in an operating room, touching an object that has not been sterilized, such as a vial, presents the risk of contamination through the operating field, and the spread of bacteria. To prevent contacting these unsterile objects, typically another individual must hold the vial while the physician loads the syringe. However, the assistance of another person obvious presents an additional risk of contamination, especially when that person's hands come into close proximity to the syringe being loaded. Thus, there is a need for a device that can be sterilized and allows a doctor or other healthcare worker to load a syringe in a sterile environment without the aid of a second individual or allows the second individual to keep his hands away from the syringe.

The prior patent application to Beal discloses such a device which provides a safety device to hold the vial. However, this device also suffers from some disadvantages. Beal discloses a safety device which is U-shaped having two symmetrical arms that must be squeezed together to grip and hold a container of medicinal or diagnostic agent. However, in order to safely grasp and hold the device against the vial, the user must hold both arms together, which can be awkward when attempting to hold the vial. The user may have a syringe in one hand and the safety device in another, while simultaneously trying to hold both arms together to securely hold the vial. A device is needed which automatically holds the vial without the use of a U-shaped safety device.

Additionally, although there are no known prior art teachings of a device such as that disclosed herein, prior art references that discuss subject matter that bears some relation to matters discussed herein are U.S. Pat. No. 2,908,923 to Schlechter (Schlechter). U.S. Pat. No. 3,214,210 to Keim (Keim), U.S. Pat. No. 5,370,020 to Fifield et. al. (Fifield), and U.S. Pat. No. 4,413,034 to Anderson (Anderson).

Schlechter discloses a lens cleaning device having a body with a handle and an outwardly extending U-shaped arm. The arm includes a lens cleaning element mounted to the U-shaped arm. Although this device is non-analogous art, the device does disclose a U-shaped arm which may be squeezed together to retain an object, namely a lens. However, Schlechter does not teach or suggest a device which automatically compresses its arms to retain a vial. Schlechter suffers from the disadvantage of requiring pressure to be applied by the user to retain the object. Schlechter also does not disclose retaining a vial or any object within the U-shaped arm.

Keim discloses a device to remove electronic tubes which includes a handle having a U-shape and a pair of parallel elongated arms which are hinged. However, Keim does not teach or suggest a device which automatically allows the arms to compress inwardly to hold a vial. Keim requires the user to hold both arms together to retain an object.

Fifield discloses a nail holder having a resilient plastic handle formed in a U-shape and a pair of parallel arms. The device is hinged and may be squeezed together to grip an object. Fifield also does not teach or suggest a device which automatically compresses without the user squeezing both arms together.

Anderson discloses a device for holding records which includes a U-shaped handle having a pair of arms. The arms must also be squeezed to together to retain an object. Anderson does not teach or suggest a device which automatically compresses its arms to retain the vial.

The above patents all disclose a generally U-shaped device for retaining objects. However, as discussed above, the patents fail to disclose a device which includes two arms that automatically compress to retain a vial. All of the above patents merely use two arms that require the user to squeeze the arms together to retain the object. Additionally, because the arms are hinged on only one end, the grasping and holding of the vial is awkward for the user when combined with the task of driving a needle into the vial.

Additionally, there are other prior art references which disclose devices for retaining objects, such as U.S. Pat. No. 3,862,776 to Sims et al. (Sims), U.S. Pat. No. 5,904,388 to Seibel (Seibel), U.S. Pat. No. 2,875,982 to Unglesby (Unglesby), and U.S. Pat. No. 4,179,954 to Whalen (Whalen). However, all of these devices are hinged on only one end and require the user to apply force to hold the arms together.

Sims discloses a tool for gripping objects. The tool includes two rigid arms which are hinged together on one end. The user must apply force to grip an object by squeezing the two arms together. Sims does not teach or suggest a device which includes arms which automatically compress to hold a vial.

Seilbel disclose a plastic bag transport device for having two arms which are used to retain a plurality of plastic bags. Seibel does not teach or suggest a device which automatically places pressure on a retained object.

Unglesby discloses a gripping device having two elongated arms which are hinged together. Unglesby does not teach or suggest a device which automatically retains an object.

Whalen discloses a pair of elongated griping members which are hinged on one end and used for opening a bottle or jar. Whalen requires the user to exert force on the members to retain an object.

Sims, Siebel, Unglesby, and Whalen all disclose two elongated members which are hinged on one side and require the user to position the members together. All of these patents suffer from the disadvantage of requiring the user to exert force by bringing the elongated members together.

Thus, it would be a distinct advantage to have an apparatus which is not hinged on one side and does not require the user to squeeze together the elongated arms to retain an object. It is an object of the present invention to provide such an apparatus.

SUMMARY OF THE INVENTION

In one aspect, the present invention is a medical safety device for retaining a container. The medical safety device includes an elongated unitary main body having a first end and an opposing second end. The main body has a longitudinal slit with a first interior wall and a second interior wall. Each wall is biased to move toward each other. The application of opposing force towards a center of the main body upon the first and second ends pushes the first interior wall away from the second interior wall to widen the slit to accommodate the container while release of the force on the ends narrows the slit, thereby retaining the container within the slit of the main body.

In another aspect, the present invention is a medical safety device for holding a container while a syringe extracts liquid from the container. The medical safety device includes an elongated unitary main body having a first end and an opposing second end. The main body has a longitudinal slit with a first interior wall and a second interior wall. Each wall is biased to move toward the opposing other wall. The slit is constructed to widen when opposing force is applied upon the first and second ends toward a center of the main body. Opposing force is applied toward a center portion of the main body to widen the slit to accommodate positioning of the container within the slit and the force is released to narrow the slit and hold the container in the medical safety device while a syringe extracts liquid from the container.

DESCRIPTION OF THE INVENTION

Figure 1:
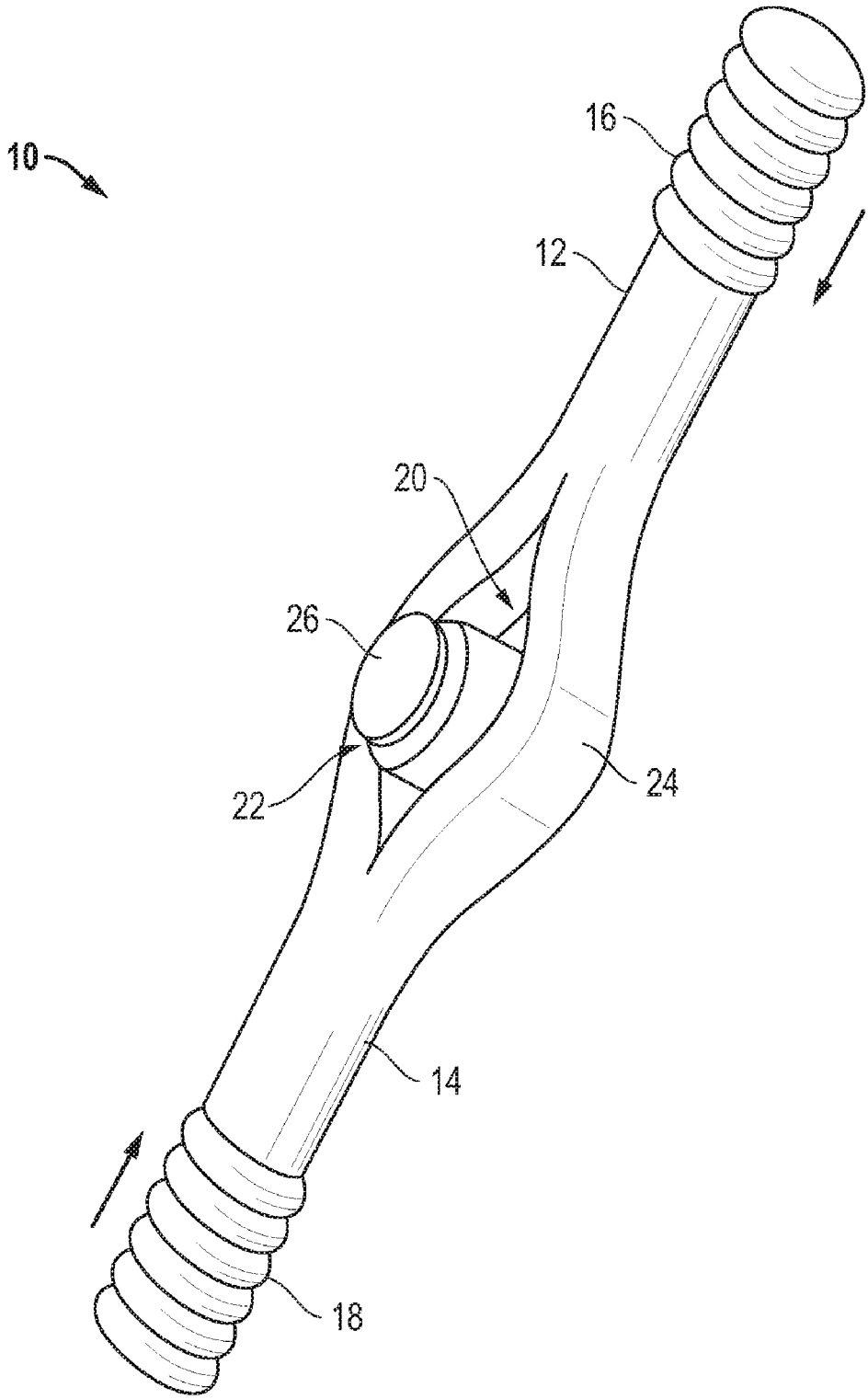
FIG. 1 is a front perspective view of a safety device holding a vial in the preferred embodiment of the present invention.

The present invention is a safety device for holding a container of medicinal or diagnostic agent. FIG. 1 is a front perspective view of a safety device 10 holding a vial 26 in the preferred embodiment of the present invention. The safety device includes a main body 50 having an extension arm 12 on a first end and an extension arm 14 on an opposite second end. The main body also includes an opening 20 located in an approximate center of the main body. The opening is aligned with the longitudinal axis of the main body and includes a first interior wall 22 and an opposing second interior wall 24. The walls are biased in such a fashion to provide inward pressure toward each other. As depicted, the interior walls grasp the vial 26 within the opening 20. The safety device may also optionally include a first hand hold 16 affixed on the end of the extension arm 12 and a second hand hold 18 affixed on the end of the extension arm 14.

The safety device 10 is preferably constructed of a strong, yet flexible material which allows some flexure, such as customized rubber compound or other rubber-like substance. Additionally, to provide an improved gripping feature to the safety device, the interior walls may be coated with foam or rubberized material, which allows the object to be held securely. Additionally, the surface of the safety device may be coated with a material which is easily sterilized without damage to the safety device.

Figure 2:
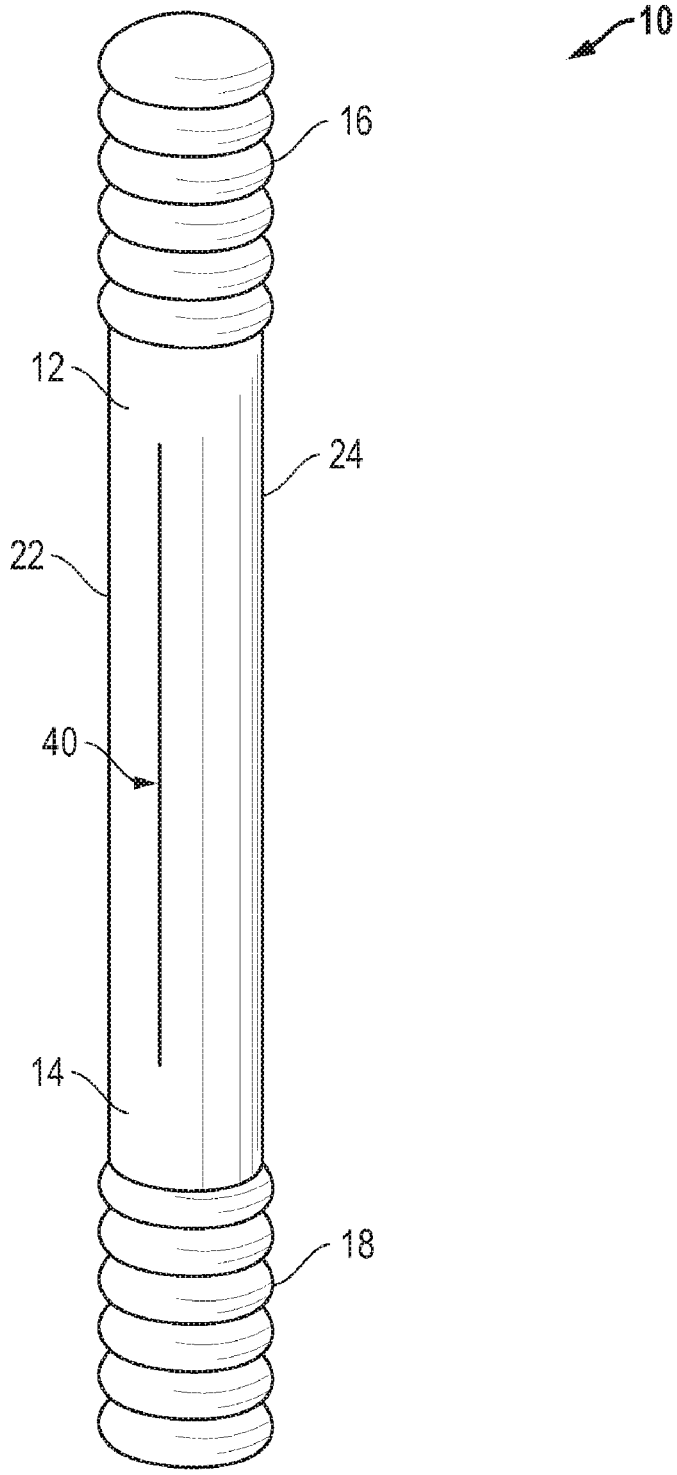
FIG. 2 is a front perspective view of the safety device of FIG. 1 in a resting state where force is not exerted upon the hand holds.

FIG. 2 is a front perspective view of the safety device 10 in a resting state where pressure is not exerted upon the hand holds 16 and 18. Without force being applied to the safety device, the opening 20 is closed by the interior walls 22 and 24 being biased inwardly to form a slit 40. The main body is constructed in such a fashion that normally the opening 20 is closed, revealing only the slit 40.

Figure 3:
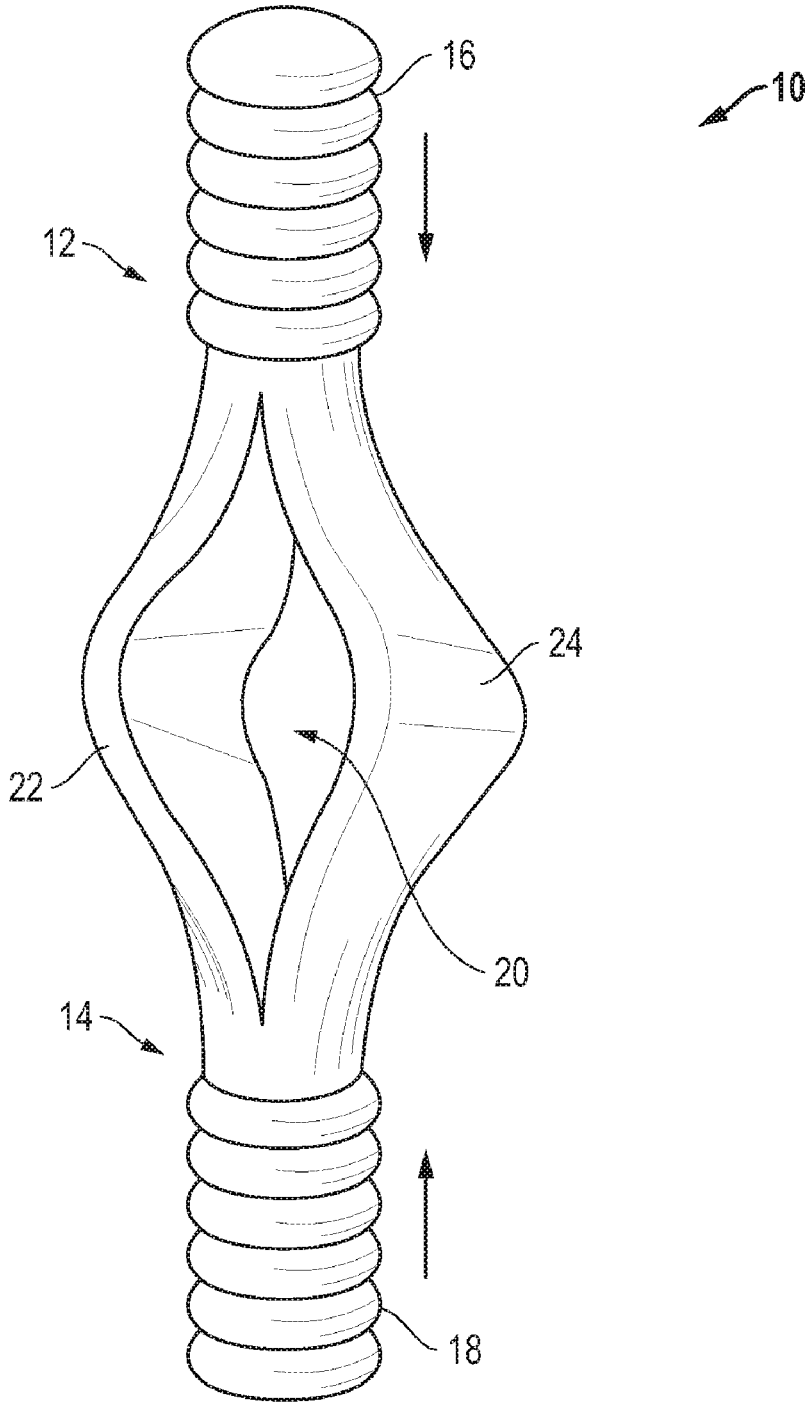
FIG. 3 is a front perspective view of the safety device where force is applied to the hand holds to widen the slit into an opening.
Figure 4:
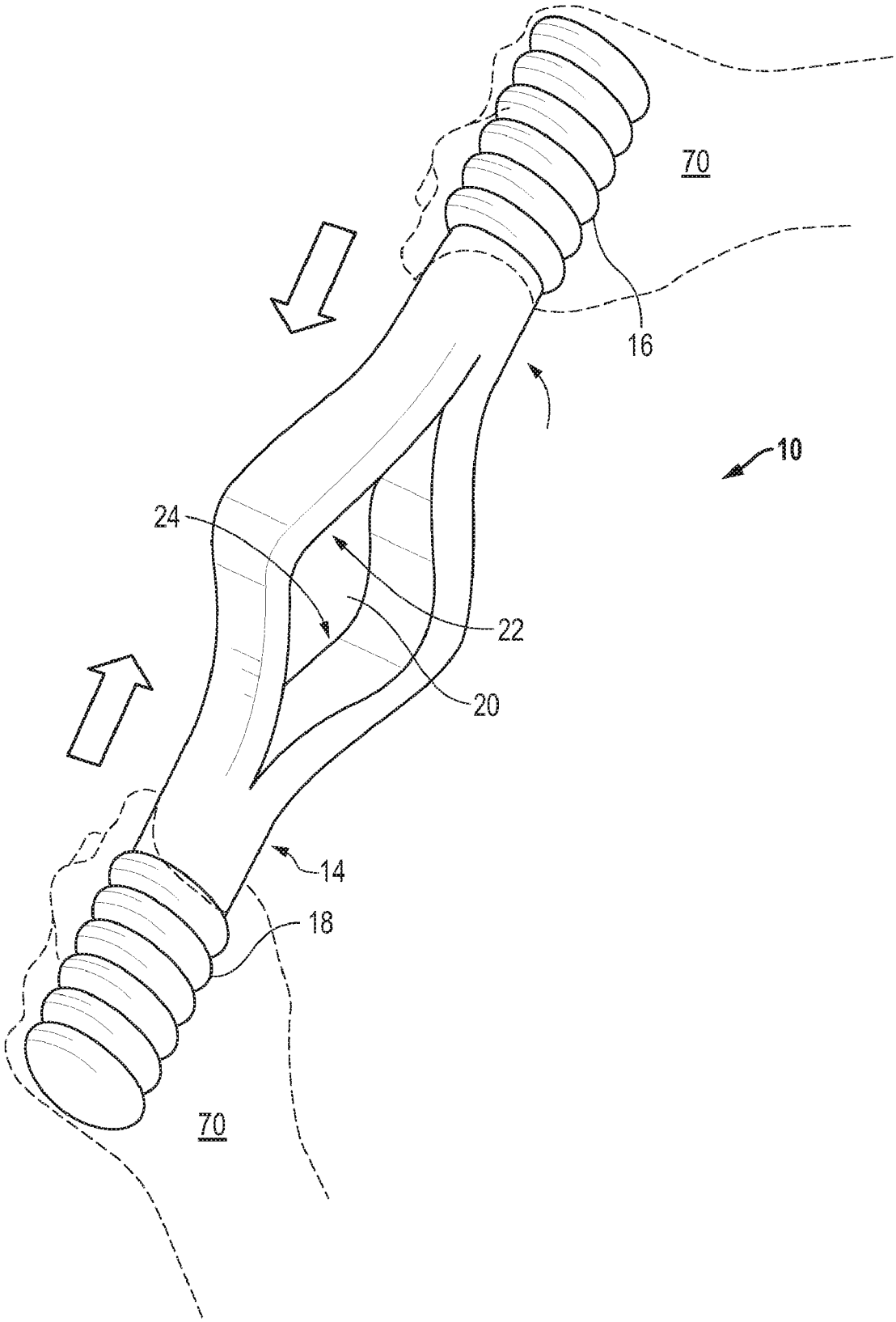
FIG. 4 is a front perspective view of the safety device being held by a user's hands in the preferred embodiment of the present invention.

FIG. 3 is a front perspective view of the safety device 10 where force is applied to the hand hold 16 and the hand hold 18 to reveal the opening 20. FIG. 4 is a front perspective view of the safety device 10 being held by a user's hands 70 in the preferred embodiment of the present invention. With pressure applied to both opposing ends by the user's hands 70 toward the center of the safety device, the interior walls 22 and 24 are driven outwardly away from the slit 40, thereby providing widening the slit into the opening 20.

Figure 5:
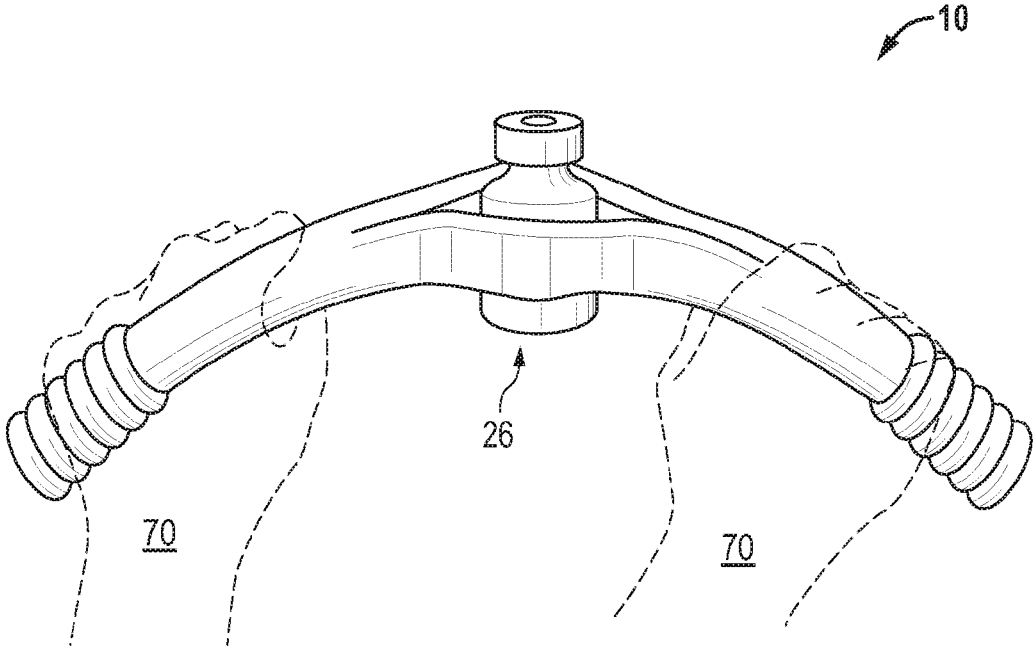
FIG. 5 is a front perspective of the safety device holding the vial.
Figure 6:
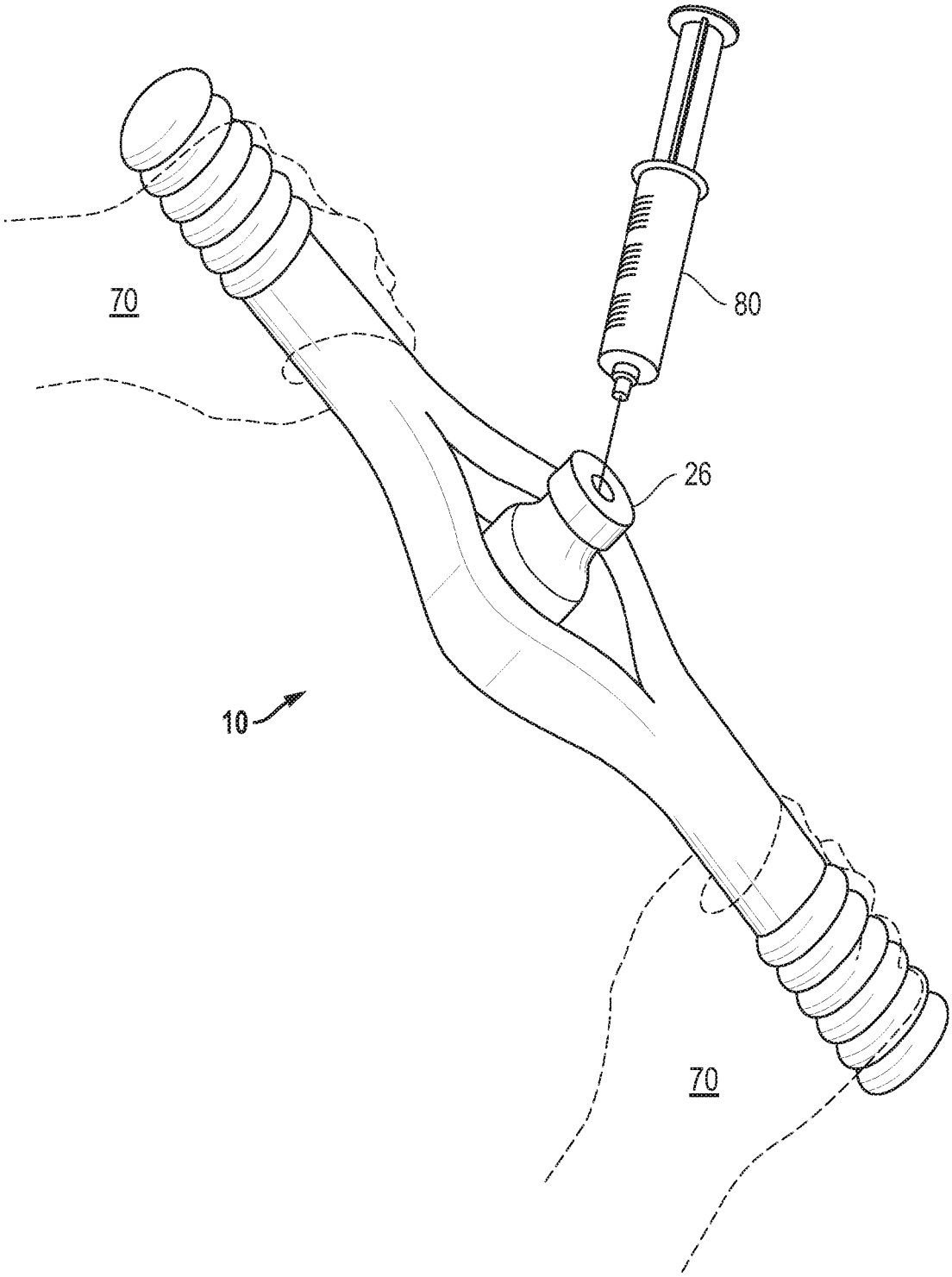
FIG. 6 is a front perspective view of the safety device with a syringe being inserted into the vial.

FIG. 5 is a front perspective of the safety device 10 holding the vial 26. The safety device is flexible, thus allowing the safety device to be flexed in different directions. As depicted in FIG. 5, the safety device is flexed to position the vial forward of the user's hands. FIG. 6 is a front perspective view of the safety device 10 with a syringe being inserted into the vial. The user may thus hold the vial without actually touching the vial 26. The hands 70 of the user are a substantial distance away from the vial, thus preventing accidentally needle sticks from a syringe 80. The user may hold the safety device with one or two hands. It should be understood that the vial is held in place without any pressure being exerted on any part of the safety device, thereby providing a far easier device to handle.

With reference to FIGS. 1-6, the operation of the safety device 10 will now be explained. When not in use, the safety device remains in a resting state as shown in FIG. 2. The interior walls 22 and 24 are biased together to form the slit 40. When it is desired to hold a container of medicinal or diagnostic agent, a user may grasp the hand holds 16 and 18 and apply opposing longitudinal force along an X-axis toward the center of the safety device (FIG. 3). With force applied upon the safety device, the interior walls are driven outwardly to reveal the opening 20. Appropriate force is applied to the handholds to increase or decrease the opening sufficiently to position the vial 26 within the opening 20. Once the vial is properly positioned in the opening, the force may be released by the user (FIG. 1). With the force released from the hand holds, the interior walls 22 and 24 are forced inwardly, thereby grasping the vial. The user may now grasp one or both ends of the hand holds and stick a syringe in the top portion of the vial. Since the user is holding the hand holds at a distance away from the vial, the risk of being stuck by a needle is reduced. Additionally, since the interior walls are biased to hold the vial, the user does not have to hold two opposing arms together to retain the vial.

The present invention provides many advantages over existing retaining safety devices. The safety device enables a user to hold a container of medicinal or diagnostic agent without actually touching the object. Thus, sterilization procedures common in the medical field may be maintained. The safety device may be sterilized and used in a sterile environment, which is critical in the medical field. Additionally, since a user is holding the vial by grasping one or both of the hand holds, the user's risk of being stuck by a needle is reduced because the user's hands are located a safe distance away from the vial. In addition, the present invention does not suffer from the disadvantages present in many of the other prior art references. Specifically, the safety device is not a U-shaped device having two arms which requires the user to actually hold the arms together to retain an object. To avoid this awkward situation, the present invention utilizes a unitary main body having a slit having two opposing interior walls which are biased toward the slit. With an objected retained within the slit, the interior walls apply pressure to the vial without any intervention by the user, which is far easier to operate by the user than the existing devices.

While the present invention is described herein with reference to illustrate embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A medical safety device for retaining a container, the medical safety device comprising:

an elongated unitary main body having a first end and an opposing second end;

a first hand hold affixed to the first end;

a second hand hold affixed to the second end; and the main body having a longitudinal slit with a first interior wall and a second interior wall, each wall biased to move toward each other;

whereby application of opposing force towards a center of the main body upon the first and second ends pushes the first interior wall away from the second interior wall to widen the slit to accommodate the container and release of the force on the ends narrows the slit, thereby retaining the container within the slit of the main body;

wherein each wall is biased to provide sufficient force directly upon side walls of the container to hold the container stationary within the longitudinal slit.

2. The medical safety device of claim 1 wherein the first interior wall and the second interior wall are coated with foam to enhance gripping of the container.

3. The medical safety device of claim 1 wherein the first interior wall and the second interior wall are coated with a rubberized material.

4. The medical safety device of claim 3 wherein the main body is constructed of a rubber material.

5. The medical safety device of claim 1 wherein the main body is constructed of a rubber compound.

6. The medical safety device of claim 1 wherein the main body is suitable for a sterile environment.

7. The medical safety device of claim 1 wherein the main body is flexible.

8. The medical safety device of claim 1 wherein the container contains a liquid and is retained within the slit of the medical safety device and the liquid is extracted from the container by a syringe.

9. A medical safety device for holding a container while a syringe extracts liquid from the container, the medical safety device comprising:

an elongated unitary main body having a first end and an opposing second end;

the main body having a longitudinal slit with a first interior wall and a second interior wall, each wall biased to move toward each other;

a first hand hold affixed to the first end; and a second hand hold affixed to the second end wherein the slit is constructed to widen when opposing force is applied upon the first and second ends toward a center of the main body;

whereby opposing force is applied toward a center portion of the main body to widen the slit to accommodate positioning of the container within the slit and the force is released to narrow the slit and hold the container in the medical safety device while a syringe extracts liquid from the container;

wherein each wall is biased to provide sufficient force directly upon side walls of the container to hold the container stationary within the longitudinal slit.

10. The medical safety device of claim 9 wherein the first interior wall and the second interior wall are coated with foam to enhance in gripping the container.

11. The medical safety device of claim 9 wherein the first interior wall and the second interior wall are coated with a rubberized material.

12. The medical safety device of claim 11 wherein the main body is constructed of a rubber material.

13. The medical safety device of claim 9 wherein the main body is constructed of a rubber compound.

14. The medical safety device of claim 9 wherein the main body is suitable for a sterile environment.

15. The medical safety device of claim 9 wherein the main body is flexible.

* * * * *